US009624568B2

(12) United States Patent
Christopherson, Jr. et al.

(10) Patent No.: US 9,624,568 B2
(45) **Date of Patent: *Apr. 18, 2017**

(54) THERMAL SPRAY APPLICATIONS USING IRON BASED ALLOY POWDER

(71) Applicants: Federal-Mogul Corporation, Southfield, MI (US); LA CORPORATION DE L'ECOLE POLYTECHNIQUE DE MONTREAL, Montreal (CA)

(72) Inventors: Denis B. Christopherson, Jr., Waupin, WI (US); Gilles L'Esperance, Quebec (CA); Jeremy Koth, Sun Prairie, WI (US); Philippe Beaulieu, Montreal (CA); Leslie John Farthing, Rugby (GB); Todd Schoenwetter, Beaver Dam, WI (US)

(73) Assignees: Federal-Mogul Corporation, Southfield, MI (US); La Corporation De L'Ecole Polytechnique De Montreal

( * ) Notice: Subject to any disclaimer, the term of this patent is extended or adjusted under 35 U.S.C. 154(b) by 583 days.

This patent is subject to a terminal disclaimer.

(21) Appl. No.: 13/790,466

(22) Filed: Mar. 8, 2013

(65) Prior Publication Data

US 2013/0186237 A1 Jul. 25, 2013

Related U.S. Application Data

(63) Continuation-in-part of application No. 12/419,683, filed on Apr. 7, 2009.

(Continued)

(51) Int. Cl.
*C23C 4/06* (2016.01)
*C23C 4/08* (2016.01)

(Continued)

(52) U.S. Cl.
CPC ..... *C23C 4/08* (2013.01); *B22F 3/115* (2013.01); *B22F 9/082* (2013.01); *C22C 1/02* (2013.01);

(Continued)

(58) Field of Classification Search
CPC .. B22F 9/04; B22F 9/082; B22F 3/115; B22F 5/02; C23C 4/06; C23C 4/065;

(Continued)

(56) References Cited

U.S. PATENT DOCUMENTS 3,150,444 A 9/1964 Reen
3,556,780 A 1/1971 Holtz, Jr.

(Continued)

FOREIGN PATENT DOCUMENTS

CN 101497978 A 8/2009
CN 102057072 A 5/2011

(Continued)

OTHER PUBLICATIONS

English translation of EP 0130177; Jan. 1985.*

(Continued)

*Primary Examiner* — Helene Klemanski
(74) *Attorney, Agent, or Firm* — Robert L. Stearns; Dickinson Wright, PLLC

(57) ABSTRACT

A thermal spray powder is provided for use in a thermal spray technique, such as flame spraying, plasma spraying, cold spraying, and high velocity oxygen fuel spraying (HVOF). The thermal spray powder is formed by water or gas atomization and comprises 3.0 to 7.0 wt. % carbon, 10.0 to 25.0 wt. % chromium, 1.0 to 5.0 wt. % tungsten, 3.5 to 7.0 wt. % vanadium, 1.0 to 5.0 wt. % molybdenum, not greater than 0.5 wt. % oxygen, and at least 40.0 wt. % iron, based on the total weight of the thermal spray powder. The thermal spray powder can be applied to a metal body, such as a piston or piston ring, to form a coating. The thermal spray powder can also provide a spray-formed part.

19 Claims, 3 Drawing Sheets

Related U.S. Application Data

(60) Provisional application No. 61/608,853, filed on Mar. 9, 2012, provisional application No. 61/043,256, filed on Apr. 8, 2008.

(51) Int. Cl.

| | |
|---|---|
| ***C22C 33/02*** | (2006.01) |
| ***B22F 9/04*** | (2006.01) |
| ***B22F 3/115*** | (2006.01) |
| ***B22F 5/02*** | (2006.01) |
| ***C22C 37/06*** | (2006.01) |
| ***B22F 9/08*** | (2006.01) |
| ***C23C 24/04*** | (2006.01) |
| ***C22C 1/02*** | (2006.01) |
| ***C23C 4/067*** | (2016.01) |

(52) U.S. Cl.
CPC ..... *C22C 33/0228* (2013.01); *C22C 33/0285* (2013.01); *C22C 37/06* (2013.01); *C23C 4/06* (2013.01); *C23C 4/067* (2016.01); *C23C 24/04* (2013.01); *B22F 5/02* (2013.01); *B22F 2998/10* (2013.01)

(58) Field of Classification Search
CPC ... C23C 4/08; C22C 33/0228; C22C 33/0285; C22C 37/06
USPC ..... 75/255, 246, 338; 420/12; 427/456
See application file for complete search history.

(56) References Cited

U.S. PATENT DOCUMENTS

| | | | | |
|---|---|---|---|---|
| 3,704,115 | A | 11/1972 | Wastenson et al. | |
| 3,846,126 | A | 11/1974 | Foley et al. | |
| 4,121,927 | A | 10/1978 | Lohman et al. | |
| 4,216,015 | A | 8/1980 | Hickl | |
| 4,348,433 | A | 9/1982 | Kammer et al. | |
| 4,361,604 | A | 11/1982 | Kushner et al. | |
| 4,822,415 | A | 4/1989 | Dorfman et al. | |
| 4,873,150 | A * | 10/1989 | Doi et al. | 428/627 |
| 4,935,266 | A | 6/1990 | Steine et al. | |
| 5,066,523 | A | 11/1991 | Steine et al. | |
| 5,108,493 | A | 4/1992 | Causton | |
| 5,328,763 | A | 7/1994 | Terry | |
| 5,344,477 | A | 9/1994 | Stasko et al. | |
| 5,462,573 | A | 10/1995 | Baker et al. | |
| 5,522,914 | A | 6/1996 | Stasko et al. | |
| 5,635,255 | A | 6/1997 | Kwon et al. | |
| 5,856,625 | A | 1/1999 | Saunders et al. | |
| 6,095,107 | A | 8/2000 | Kloft et al. | |
| 6,095,126 | A | 8/2000 | Kloft et al. | |
| 6,123,748 | A | 9/2000 | Whitaker et al. | |
| 6,159,554 | A | 12/2000 | Kloft et al. | |
| 6,168,755 | B1 * | 1/2001 | Biancaniello et al. | 75/246 |
| 6,475,262 | B1 | 11/2002 | Maulik et al. | |
| 6,749,894 | B2 | 6/2004 | Subramanian et al. | |
| 6,756,083 | B2 | 6/2004 | Holmqvist et al. | |
| 6,887,585 | B2 | 5/2005 | Herbst-Dederichs | |
| 7,487,840 | B2 | 2/2009 | Gammage et al. | |
| 7,998,238 | B2 * | 8/2011 | Takayama et al. | 75/246 |
| 9,162,285 | B2 * | 10/2015 | Christopherson, Jr. | C22C 33/0285 |
| 2002/0197500 | A1 | 12/2002 | Holmqvist et al. | |
| 2004/0206204 | A1 | 10/2004 | Holmqvist et al. | |
| 2005/0132843 | A1 | 6/2005 | Jiang et al. | |
| 2006/0063020 | A1 | 3/2006 | Barbezat | |
| 2006/0121292 | A1 | 6/2006 | Weaver et al. | |
| 2006/0159376 | A1 * | 7/2006 | Takayama et al. | 384/276 |
| 2008/0075968 | A1 * | 3/2008 | Bergman et al. | 428/570 |
| 2009/0162237 | A1 | 6/2009 | Rakowski et al. | |
| 2009/0252634 | A1 | 10/2009 | Scholl et al. | |
| 2009/0252636 | A1 | 10/2009 | Christopherson et al. | |
| 2009/0252639 | A1 * | 10/2009 | Bergman et al. | 420/12 |
| 2010/0047105 | A1 | 2/2010 | Bergstrom et al. | |
| 2011/0081540 | A1 * | 4/2011 | Kennedy et al. | 427/456 |
| 2011/0085930 | A1 | 4/2011 | Valls | |
| 2011/0101621 | A1 * | 5/2011 | Kennedy et al. | 427/456 |
| 2011/0254230 | A1 | 10/2011 | Jarosinski et al. | |
| 2013/0315772 | A1 * | 11/2013 | Christopherson et al. | 420/12 |

FOREIGN PATENT DOCUMENTS

| | | | |
|---|---|---|---|
| CN | 102286702 | A | 12/2011 |
| DE | 3822874 | A1 | 1/1989 |
| DE | 19733306 | C1 | 5/1999 |
| DE | 19845349 | A1 | 4/2001 |
| DE | 102008032042 | B3 | 4/2010 |
| EP | 130177 | A1 | 1/1985 |
| EP | 0130177 | A1 * | 1/1985 |
| EP | 266149 | A2 | 5/1988 |
| EP | 0625392 | A1 | 5/1994 |
| JP | S5339693 | A | 4/1978 |
| JP | S5339693 | B2 | 10/1978 |
| JP | 59064748 | A | 4/1984 |
| JP | 8120397 | A | 5/1996 |
| JP | 11106890 | A | 4/1999 |
| JP | 2002309361 | A | 10/2002 |
| JP | 2003-55747 | | 2/2003 |
| JP | 2006159269 | A | 6/2006 |
| JP | 2006316745 | A | 11/2006 |
| JP | 2008297572 | A | 12/2008 |
| WO | WO98/58093 | | 12/1998 |
| WO | WO-9961673 | A | 12/1999 |
| WO | WO-2006117030 | A1 | 11/2006 |
| WO | WO-2008017848 | A1 | 2/2008 |
| WO | WO2008/034614 | A1 | 3/2008 |
| WO | WO2008/036026 | A1 | 3/2008 |
| WO | WO2009112118 | A1 | 9/2009 |
| WO | WO-2009115157 | A1 | 9/2009 |
| WO | 2009126674 | A2 | 10/2009 |
| WO | 2013134606 | A2 | 9/2013 |

OTHER PUBLICATIONS

"An Introduction to Thermal Spray"; Oerlikon Metco; Issue 5; Oct. 2014; 24 pages.*

Ceramic Industry; "Improving Surfaces with HVOF-Sprayed Coatings"; Dec. 2003; 9 pages.*

M.B. Beardsley; "Iron-Based Amosphous Coatings Produced by HVOF Thermal Spray Processing-Coating Structure and Properties"; LLNL-JRNL-402708; Apr. 4, 2008; 20 pages.*

R.H. Palma, V. Martinex and J.J.Urcola, Sintering Behavior of T42 Water Atomised High Speed Steel Powder Under Vacuum and Industrial Atmospheres With Free Carbon Addition, Powder Metallurgy 1989 vol. 32 No. 4, pp. 291-299.

Xinqing Ma and Peter Ruggiero, Ultrasmooth, Dense Hardsurface Coating Applied by Advanced HVOF Process, Advanced Materials & Processes, Feb. 2013.

International Search Report mailed Sep. 12, 2013 (PCT/US2013/029792).

Liu et al., "Research on Plasma Piston Ring Surface about its Plasma Spraying and Wear Resistance," Diesel Engine, Dec. 31, 2004, pp. 38-40.

Fu et al., "Application of the Thermal Spraying Technology in Aeroengine Part and Its Service," vol. 1, No. 2, May 31, 2006, pp. 61-64.

R. H. Palma, V. Martinez, and J. J. Urcola, Powder Metallurgy 1989, vol. 32, No. 4, pp. 291-299: Sintering Behavious of T42 Water Atomised High Speed Steel Powder Under Vacuum and Industrial Atmospheres With Free Carbon Addition.

* cited by examiner

THERMAL SPRAY APPLICATIONS USING IRON BASED ALLOY POWDER

CROSS REFERENCE TO RELATED APPLICATION

This application claims the benefit of Provisional Application Ser. No. 61/608,853 filed Mar. 9, 2012, the entire contents of which is hereby incorporated by reference in its entirety. This application is also a Continuation-in-Part and claims the benefit of U.S. application Ser. No. 12/419,683 filed on Apr. 7, 2009, which claims the benefit of U.S. Provisional Application Ser. No. 61/043,256 filed Apr. 8, 2008 the contents of which are hereby incorporated by reference in their entirety.

BACKGROUND OF THE INVENTION

1. Field of the Invention

This invention relates generally to wear resistant thermal spray powders, methods of forming the same, and applications thereof.

2. Related Art

Thermal spray techniques are used to apply wear resistant coatings to automotive engine components, such as pistons and piston rings. The coatings can protect the surface of the piston rings from wear as the piston slides along the cylinder. The coatings also reduce corrosion and oxidation of the piston caused by exposure to extreme temperatures and pollutants in the combustion chamber of the engine. Such wear resistant coatings have been formed from various ceramic materials, chromium-based powders, and molybdenum based powders. Examples of thermal spraying techniques include combustion, electrical discharge, cold spraying, and laser.

SUMMARY OF THE INVENTION

One aspect of the invention provides a powder metal material for use in a thermal spray technique, comprising: 3.0 to 7.0 wt. % carbon, 10.0 to 25.0 wt. % chromium, 1.0 to 5.0 wt. % tungsten, 3.5 to 7.0 wt. % vanadium, 1.0 to 5.0 wt. % molybdenum, not greater than 0.5 wt. % oxygen, and at least 40.0 wt. % iron, based on the total weight of the powder metal composition.

Another aspect of the invention provides a method of forming a powder metal material for use in a thermal spray technique, comprising the steps of: providing a melted iron based alloy including 3.0 to 7.0 wt. % carbon, 10.0 to 25.0 wt. % chromium, 1.0 to 5.0 wt. % tungsten, 3.5 to 7.0 wt. % vanadium, 1.0 to 5.0 wt. % molybdenum, not greater than 0.5 wt. % oxygen, and at least 40.0 wt. % iron, based on the total weight of the melted iron based alloy; and atomizing the melted iron based alloy to provide water atomized droplets of the iron based alloy.

Yet another aspect of the invention provides a wear resistant component, comprising: a thermal-sprayed powder metal material, wherein the thermal-sprayed powder metal material comprises 3.0 to 7.0 wt. % carbon, 10.0 to 25.0 wt. % chromium, 1.0 to 5.0 wt. % tungsten, 3.5 to 7.0 wt. % vanadium, 1.0 to 5.0 wt. % molybdenum, not greater than 0.5 wt. % oxygen, and at least 40.0 wt. % iron, based on the total weight of the thermal-sprayed powder metal material.

Another aspect of the invention provides a method of forming a wear resistant component comprising the steps of: spraying a powder metal material, wherein the powder metal material comprises 3.0 to 7.0 wt. % carbon, 10.0 to 25.0 wt. % chromium, 1.0 to 5.0 wt. % tungsten, 3.5 to 7.0 wt. % vanadium, 1.0 to 5.0 wt. % molybdenum, not greater than 0.5 wt. % oxygen, and at least 40.0 wt. % iron, based on the total weight of the powder metal material.

The thermal spray powder provides exceptional wear resistance at a low cost relative to other materials used in thermal spray techniques. The thermal spray powder also has a lower melting point and therefore requires lower temperatures during the thermal spray technique, which conserves energy. The thermal spray powder may also be applied to a metal body, such as a piston or piston ring, without causing damage to the body. In addition, during the thermal spray technique, the thermal spray powder may provide improved oxidation resistance compared to other ferrous based materials used in thermal spray techniques.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION

Figure 1:
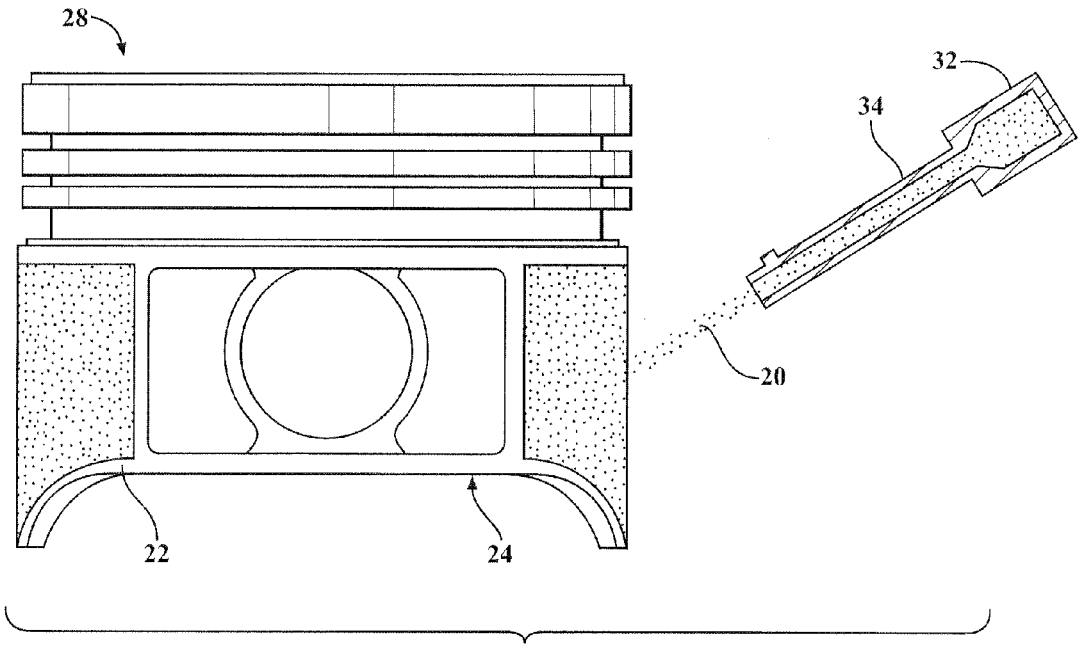
FIG. 1 illustrates a high velocity oxygen fuel spraying (HVOF) chamber gun spraying a thermal spray powder on an outer surface of a piston according to one embodiment of the invention.

One aspect of the invention provides a wear resistant powder metal material for use in a thermal spray technique, also referred to as a thermal spray process or application. The powder metal material, also referred to as a thermal spray powder 20, is formed by atomizing a melted iron based alloy including carbon (C), chromium (Cr), tungsten (W), vanadium (V), molybdenum (Mo), and iron (Fe). The thermal spray powder 20 is iron-based and optionally includes other components, such as cobalt (Co), niobium (Nb), titanium (Ti), manganese (Mn), sulfur (S), silicon (Si), phosphorous (P), zirconium (Zr), and tantalum (Ta).

The thermal spray powder 20 includes chromium, tungsten, vanadium, and molybdenum in amounts sufficient to provide exceptional wear resistance at a reduced cost, compared to other thermal spray materials. These elements are also present in amounts sufficient to form metal carbides. In one embodiment, the thermal spray powder 20 includes 10.0 to 25.0 wt. % chromium, preferably 11.0 to 15.0 wt. % chromium, and most preferably 13.0 wt. % chromium; 1.0 to 5.0 wt. % tungsten, preferably 1.5 to 3.5 wt. % tungsten, and most preferably 2.5 wt. % tungsten; 3.5 to 7.0 wt. % vanadium, preferably 4.0 to 6.5 wt. % vanadium, and most preferably 6.0 wt. % vanadium; 1.0 to 5.0 wt. % molybdenum, preferably 1.0 to 3.0 wt. % molybdenum, and most preferably 1.5 wt. % molybdenum.

The thermal spray powder 20 includes the carbon in an amount sufficient to provide metal carbides in an amount greater than 15 vol. %, based on the total volume of the thermal spray powder 20. In one embodiment, the thermal spray powder 20 includes at least 3.0 wt. % carbon, or 3.0 to 7.0 wt. % carbon, and preferably about 3.8 wt. % carbon, based on the total weight of the thermal spray powder 20. As the amount of carbon in the thermal spray powder 20 increases so does the hardness of the thermal spray powder 20. This is because greater amounts of carbon form greater amounts of carbides during the atomization step, which increases the hardness. The amount of carbon in the thermal spray powder 20 is referred to as carbon total ($C_{tot}$).

The thermal spray powder 20 also includes a stoichiometric amount of carbon ($C_{stoich}$), which represents the total carbon content that is tied up in the alloyed carbides at equilibrium. The type and composition of the carbides vary as a function of the carbon content and of the alloying elements content.

The $C_{stoich}$ necessary to form the desired amount of metal carbides during atomization depends on the amount of carbide-forming elements present in the thermal spray powder 20. The $C_{stoich}$ for a particular composition is obtained by multiplying the amount of each carbide-forming element by a multiplying factor specific to each element. For a particular carbide-forming element, the multiplying factor is equal to the amount of carbon required to precipitate 1 wt. % of that particular carbide-forming element. The multiplying factors vary based on the type of precipitates formed, the amount of carbon, and the amount of each of the alloying elements. The multiplying factor for a specific carbide will also vary with the amount of carbon and the amount of the alloying elements.

For example, to form precipitates of $(Cr_{23.5}Fe_{7.3}V_{63.1}Mo_{3.2}W_{2.9})_8C_7$, also referred to as $M_8C_7$, in a thermal spray powder 20, the multiplying factors of the carbide-forming elements are calculated as follows. First, the atomic ratio of the $M_8C_7$ carbide is determined: 1.88 atoms of Cr, 0.58 atoms of Fe, 5.05 atoms of V, 0.26 atoms of Mo, 0.23 atoms of W, and 7 atoms of C. Next, the mass of each element per one mole of the $M_8C_7$ carbide is determined: V=257.15 grams, Cr=97.76 grams, Fe=32.62 grams, Mo=24.56 grams, W=42.65 grams, and C=84.07 grams. The weight ratio of each carbide-forming element is then determined: V=47.73 wt. %, Cr=18.14 wt. %, Fe=6.05 wt. %, Mo=4.56 wt. %, W=7.92 wt. %, and C=15.60 wt. %. The weight ratio indicates 47.73 grams of V will react with 15.60 grams of C, which means 1 gram of V will react with 0.33 grams of C. To precipitate 1.0 wt. % V in the $M_8C_7$ carbide you need 0.33 wt. % carbon, and therefore the multiplying factor for V is 0.33. The same calculation is done to determine the multiplying factor for Cr=0.29, Mo=0.06, and W=0.03.

The $C_{stoich}$ in the thermal spray powder 20 is next determined by multiplying the amount of each carbide-forming element by the associated multiplying factor, and then adding each of those values together. For example, if the thermal spray powder 20 includes 4.0 wt. % V, 13.0 wt. % Cr, 1.5 wt. % Mo, and 2.5 wt. % W, then $C_{stoich}$=(4.0*003)+(13.0*0.29)+(1.5*0.06)+(2.5*0.03)=5.26 wt. %.

In addition, the thermal spray powder 20 includes a $C_{tot}/C_{stoich}$ amount less than 1.1. Therefore, when the thermal spray powder 20 includes carbon at the upper limit of 7.0 wt. %, the $C_{stoich}$ will be 6.36 wt. % carbon (7.0 wt. % carbon/1.1).

The table below provides examples of other carbide types that can be found in the thermal spray powder 20, and multiplying factors for Cr, V, Mo, and W for generic carbide stoichiometry. However, the metal atoms in each of the carbides listed in the table could be partly replaced by other atoms, which would affect the multiplying factors.

| Element | Carbide type | Example of stoichiometry | Multiplying factor $f_M$ (w %/w %) |
|---|---|---|---|
| Cr | $M_7C_3$ | $Cr_{3.5}Fe_{3.5}C_3$ | 0.20 |
| | | $Cr_4Fe_3C_3$ | 0.17 |
| | | $(Cr_{34}Fe_{66})_7C_3$ | 0.29 |
| V | $M_8C_7$ | $(V_{63}Fe_{37})_8C_7$ | 0.33 |
| Mo | $M_6C$ | $Mo_3Fe_3C$ | 0.04 |
| | | $Mo_2Fe_4C$ | 0.06 |
| W | $M_6C$ | $W_3Fe_3C$ | 0.02 |
| | | $W_2Fe_4C$ | 0.03 |

The metal carbides are formed during the atomization process and are present in an amount of at least 15.0 vol. %, but preferably in an amount of 40.0 to 60.0 vol. %, or 47.0 to 52.0 vol. %, and typically about 50.0 vol. %. In one embodiment, the thermal spray powder 20 includes chromium-rich carbides, molybdenum-rich carbides, tungsten-rich carbides and vanadium-rich carbides in a total amount of about 50.0 vol. %.

The metal carbides have a nanoscale microstructure. In one embodiment, the metal carbides have a diameter between 1 and 400 nanometers. The fine nano-carbide structure may improve the adherence of the thermal spray powder 20 to an outer surface 22, 122 of a metal body 24, 124. Therefore, a wear resistant coating formed of the thermal spray powder 20 is less prone to flaking, chipping, and delamination. The fine carbide structure may also provide a more homogeneous microstructure, and therefore an improved impact and fatigue resistance compared to thermal spray materials with coarser carbide microstructures. As alluded to above, the carbides can be of various types, including $M_8C_7$, $M_7C_3$, MC, $M_6C$, $M_{23}C_6$, and $M_3C$, wherein M is at least one metal atom, such as Fe, Cr, V, Mo, and/or W, and C is carbon. In one embodiment, the metal carbides are selected from the group consisting of: $M_8C_7$, $M_7C_3$, $M_6C$; wherein $M_8C_7$ is $(V_{63}Fe_{37})_8C_7$, $M_7C_3$ is selected from the group consisting of: $(Cr_{34}Fe_{66})_7C_3$, $Cr_{3.5}Fe_{3.5}C_3$, and $Cr_4Fe_3C_3$; and $M_6C$ is selected from the group consisting of: $Mo_3Fe_3C$, $Mo_2Fe_4C$, $W_3Fe_3C$, and $W_2Fe_4C$.

The microstructure of the thermal spray powder 20 also includes nanoscale austenite, and may include nanoscale martensite, along with the nanoscale carbides. The carbon is also present in an amount sufficient to limit oxidation of the thermal spray powder 20 during the thermal spray process. Oxidation can occur due to poor atmosphere control, lack of cleanliness, and temperature during the thermal spray process.

The thermal spray powder 20 can optionally include other elements, which may contribute to improved wear resistance or enhance another material characteristic. In one embodiment, the thermal spray powder 20 includes at least one of cobalt, niobium, titanium, manganese, sulfur, silicon, phosphorous, zirconium, and tantalum. In one embodiment, the thermal spray powder 20 includes at least one of 4.0 to 15.0 wt. % cobalt; up to 7.0 wt. % niobium; up to 7.0 wt. % titanium; up to 2.0 wt. % manganese; up to 1.15 wt. % sulfur; up to 2.0 wt. % silicon; up to 2.0 wt. % phosphorous; up to 2.0 wt. % zirconium; and up to 2.0 wt. % tantalum. In one embodiment, thermal spray powder 20 contains pre-alloyed sulfur to form sulfides or sulfur containing compounds in the powder. Sulfides (ex. MnS, CrS) are known to improve machinability and could be beneficial to wear resistance.

The remaining balance of the thermal spray powder 20 composition is iron. In one embodiment, the thermal spray powder 20 includes at least 40.0 wt. % iron, or 50.0 to 81.5 wt % iron, and preferably 70.0 to 80.0 wt. % iron. The thermal spray powder 20 typically has a microhardness of 800 to 1,500 $Hv_{50}$. The high hardness contributes to the exceptional wear resistance of the wear resistant coating 26 and the fine structure should improve toughness. The microhardness of the thermal spray powder 20 increases with increasing amounts of carbon.

In one exemplary embodiment, the thermal spray powder 20 includes 3.8 wt. % carbon, 13.0 wt. % chromium, 2.5 wt. % tungsten, 4.0-6.0 wt. % vanadium, 1.5 wt. % molybdenum, 0.2 wt. % oxygen, 70.0 to 80.0 wt. % iron, and impurities in an amount not greater than 2.0 wt. %.

The thermal spray powder 20 of the exemplary embodiment has a melting point of about 1,235° C. (2,255° F.), and it will be completely melted at that temperature. The melting point of thermal spray powder 20 will however vary slightly as a function of the carbon content and alloying element content. However, the thermal spray powder 20 may include a small fraction of a liquid phase at a temperature as low as 1,150° C. The low melting point provides several advantages during the thermal spray process, compared to thermal spray materials having higher melting points. Less energy is needed to apply the thermal spray powder 20 to the outer surface 22 of the body 24 being coated. The thermal spray powder 22 can be sprayed at a lower temperature, which may provide less heat input to the body 24 being coated, less manufacturing equipment wear, possibly lower porosity in the wear resistant coating 26, and less oxidation of the thermal spray powder 20 during the spraying process. The lower melting point also provides the opportunity to use a cold spraying technique.

Figure 5:
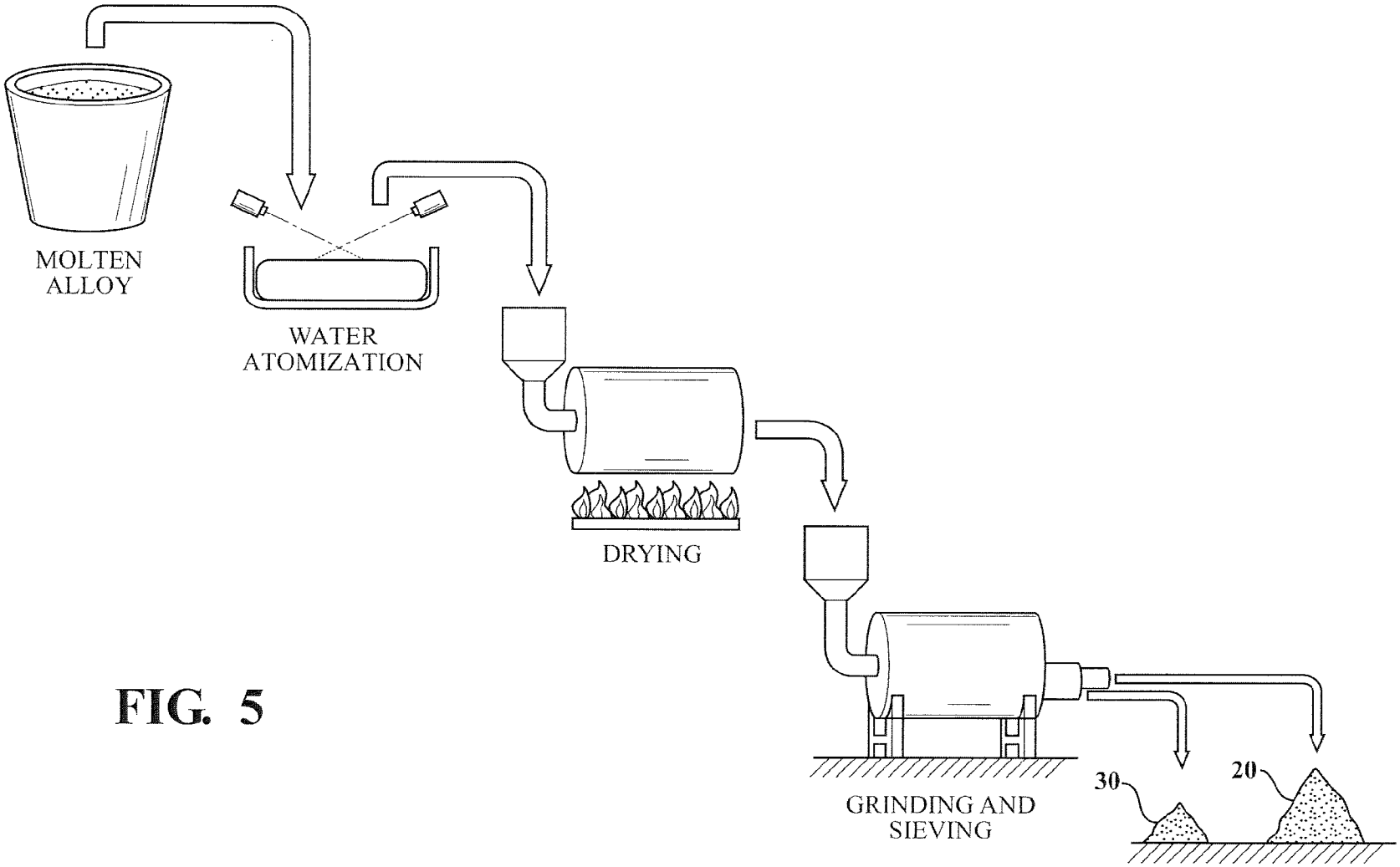
FIG. 5 is a schematic illustration of an exemplary process used to form the thermal spray powder.

The thermal spray powder 20 is formed by water or gas atomizing a melted iron based alloy. An exemplary process of forming the thermal spray powder 20 using water atomization is shown in FIG. 5. However, the water atomization step could be replaced by a gas atomization step. In one embodiment, the iron based alloy provided prior to atomization includes 3.0 to 7.0 wt. % carbon, 10.0 to 25.0 wt. % chromium, 1.0 to 5.0 wt. % tungsten, 3.5 to 7.0 wt. % vanadium, 1.0 to 5.0 wt. % molybdenum, and at least 40.0 wt. % iron. The iron based alloy is typically provided as a pre-alloy including the carbon, chromium, tungsten, vanadium, molybdenum, and iron. The iron based alloy also has a low oxygen content, preferably not greater than 0.5 wt. %. The carbon content of the iron based alloy is sufficient to protect the alloy from oxidizing during the melting and atomizing steps.

Once the iron based alloy is melted, it is fed to a water atomizer or a gas atomizer. The high carbon content of the iron based alloy decreases the solubility of the oxygen in the melted iron based alloy. Depleting the oxygen level in the melted iron based alloy has the benefit of shielding the carbide-forming elements from oxidizing during the melting and atomizing steps. The relatively high carbon content allows the austenite, or possibly martensite, to form in the matrix of the thermal spray powder 20, in which the carbides precipitate, during the atomizing step. Increasing the amount of carbide-forming alloying elements in the iron based alloy can also increase the amount of carbides formed in the matrix during the atomizing step.

In the atomizer, a stream of the melted iron based alloy is impacted by a flow of high-pressure water or gas which disperses and rapidly solidifies the melted iron based alloy stream into fully alloyed metal droplets. Gas atomization typically yields particles having a round shape, whereas water atomization typically yields particles of irregular shape. Preferably, each droplet possesses the fully alloyed chemical composition of the melted batch of metal, including at least 3.0 wt. % carbon, 10.0 to 25.0 wt. % chromium, 1.0 to 5.0 wt. % tungsten, 3.5 to 7.0 wt. % vanadium, 1.0 to 5.0 wt. % molybdenum, and at least 40.0 wt. % iron. Each droplet also preferably includes a uniform distribution of carbides. The main elements of the droplets are protected from oxidation by the high carbon content of the powder during the melting and atomizing steps. The high carbon content and low oxygen content also limits the oxidization during the atomizing step. However, the outside surface of the droplets may become oxidized, possibly due to exposure to water or unprotected atmosphere. Some properties can be improved using gas atomization over water atomization, for example better flow, apparent density, and lower oxygen content.

The atomized droplets are then passed through a dryer and into a grinder where the atomized material is mechanically ground or crushed, and then sieved. The hard and very fine nano-structure of the droplets improves the ease of grinding. A ball mill or other mechanical size reducing device may be employed. In addition, the droplets could be annealed prior to grinding the droplets, but no annealing step is required prior to grinding the droplets, and typically no annealing step is conducted. If an outer oxide skin is formed on the atomized droplets during the atomization step, the mechanical grinding fractures and separates the outer oxide skin from the bulk of the droplets. The ground droplets are then separated from the oxide skin to yield the atomized thermal spray powder 20 and oxide particles 30, as shown in FIG. 5. In certain cases, such as when gas atomization is used, the outer oxide skin is minimal and can be tolerated without removal. However, the mechanical grinding step can still be used to fracture and reduce the size of the droplets. The thermal spray powder 20 may be further sorted for size, shape and other characteristics normally associated with powder metal. The thermal spray powder 20 can then be used to form a wear resistant component 28, 128, 228 such as a piston or piston ring.

Figure 2:
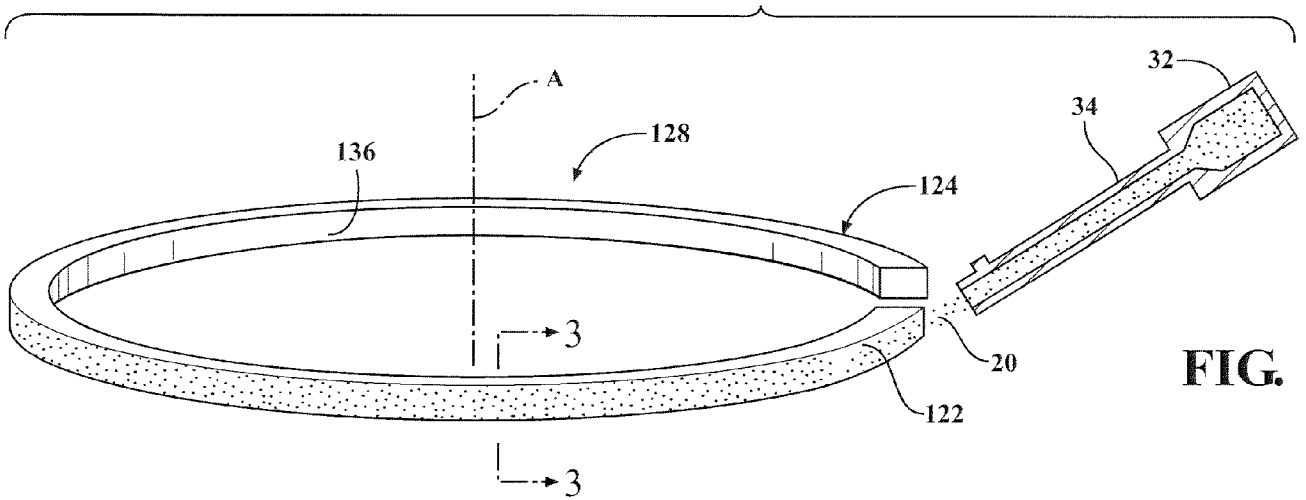
FIG. 2 illustrates the HVOF chamber gun spraying the thermal spray powder on an outer surface of a piston ring according to another embodiment of the invention.

FIG. 1 illustrates an example of the wear resistant component 28 including the thermal spray powder 20. In FIG. 1, the wear resistant component 28 is a piston including a body 24, specifically a skirt, presenting an outer surface 22. The thermal spray powder 20 is applied to the outer surface 22 of the body 24 by a thermal spraying technique to form a wear resistant coating on the outer surface 22. The wear resistant coating typically has a microhardness of 800 to 1,500 $Hv_{50}$. FIG. 2 illustrates another example of the wear resistant component 128 including the thermal spray powder 20. The wear resistant component 128 includes a body 124, specifically an uncoated piston ring, presenting an inner surface 136 surrounding a center axis A and an outer surface 122 facing opposite the inner surface 136. The thermal spray powder 20 is applied to the outer surface 122 by a thermal spraying technique to form a wear resistant coating on the outer surface 122.

The thermal spray powder 20 can also be used to form wear resistant coatings on other components (not shown), for example turbine blades, transmission parts, exhaust system components, crankshafts, other automotive components, pulp and paper rollers, oil and petrochemical drilling components, golf clubs, and surgical applications.

Figure 4:
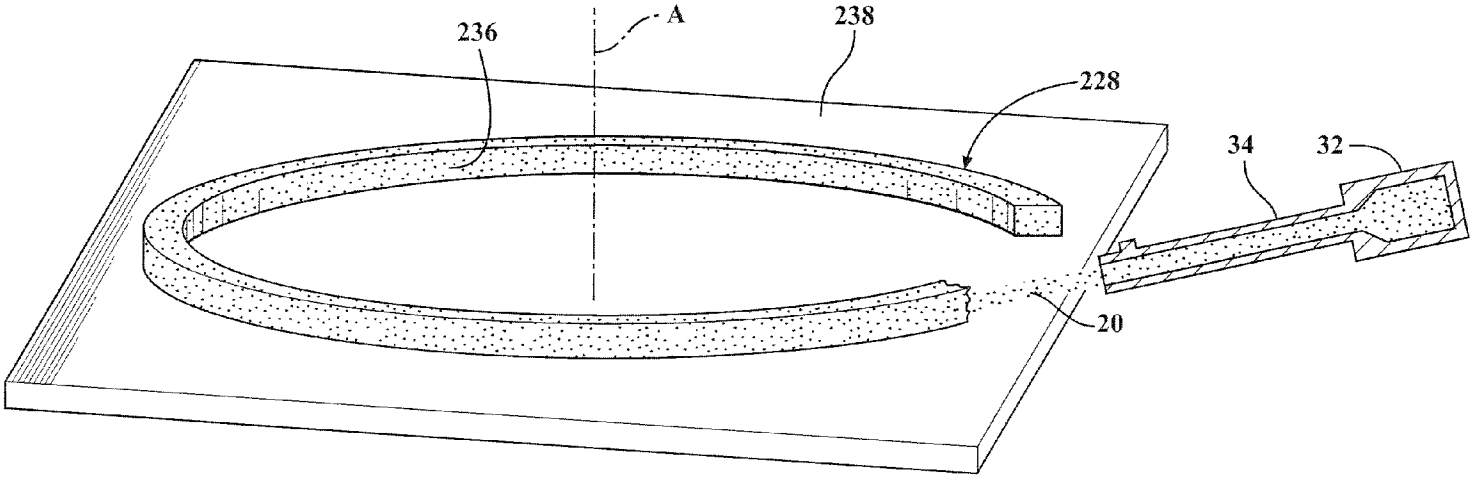
FIG. 4 illustrates the HVOF chamber gun spraying the thermal spray powder to form a spray-formed part according to another embodiment of the invention.

FIG. 4 is another example of the wear resistant component 228, specifically a piston ring, wherein the wear resistant component 228 consists entirely of the thermal spray powder 20. The wear resistant component 228 presents an inner surface 236 surrounding a center axis A and an outer surface 222 facing opposite the inner surface 236. This wear resistant component 228 is referred to as a spray-formed part. The spray-formed part typically has a microhardness of 800 to 1,500 $Hv_{50}$.

Various thermal spray techniques can be used to form the wear resistant component 28, 128, 228. Four typical thermal spray techniques are combustion, electrical discharge, cold spray, and laser. Each thermal spray technique includes spraying the thermal spray powder 20, either onto the outer surface 22, 122 of the body 24, 124 to form the wear resistant coating, or onto a substrate 238 to form the spray-formed part. The spraying step includes accelerating the thermal spray powder 20 at a high velocity, which can be up to a supersonic velocity. Once the thermal spray powder 20 has been sprayed at the high velocity to form the coating or the spray-formed part, it can be referred to as a thermal-sprayed powder or thermal-sprayed coating. The combustion, electrical discharge, and laser techniques include melting the thermal spray powder 20 before spraying the melted powder. These techniques include heating the thermal spray powder 20 and then accelerating the heated thermal spray powder 20 to the outer surface 22, 122 of the body 24, 124 or onto the substrate 238, at a high velocity while the thermal spray powder 20 is heated.

One example of the combustion technique includes flame spraying, such as powder flame spraying or wire flame spraying. Another example of the combustion technique is high velocity oxygen fuel spraying (HVOF), which involves oxygen and gaseous fuels (HVOF-G) or liquid fuels (HVOF-K).

The electrical discharge technique can include plasma spraying or wire arc spraying. The plasma spraying is typically conducted under inert gas (IPS), a vacuum (VPS), or by dispersing the thermal spray powder 20 in a liquid suspension before injecting the thermal spray powder into a plasma jet (SPS). The plasma spraying can also include atmospherical plasma spraying (APS), high pressure plasma spraying (HPPS), water-stabilized plasma spraying (WSPS), reactive plasma spraying (RPS), or underwater plasma spraying (UPS). If nitrogen is used as the inert gas during the plasma spraying process, there is a potential to form vanadium carbonitrides, thus improving hardness and wear resistance. This potential is controlled by the processing parameters and the chemistry of the thermal spray powder 20 before the spraying process.

The most preferred thermal spray techniques are powder flame spraying, plasma spraying, cold spraying, and high velocity oxygen fuel spraying (HVOF). FIGS. 1, 2, and 4 illustrate a step in the HVOF process, wherein a HVOF chamber gun sprays the thermal spray powder 20 on the outer surface 22, 122 of the body 24, 124, or onto the substrate 238. The HVOF chamber gun includes a pressurized combustion chamber 32 in fluid communication with a nozzle 34. The combustion chamber 32 contains a mixture of carrier gas, such as oxygen, and fuel, such as of acetylene, hydrogen, propane, or propylene. The mixture is ignited to produce a high-pressure flame and creating a pressure in the combustion chamber. The flame is formed through the nozzle 34 to accelerate the carrier gas to a high velocity, which can be up to a supersonic velocity. The thermal spray powder 20 is then fed axially into the high pressure combustion chamber 32 or directly through the side of the nozzle 34. The carrier gas accelerates the thermal spray powder 20 out of the HVOF chamber gun at a high velocity.

Figure 3:
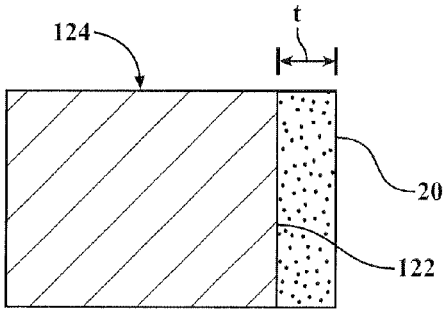
FIG. 3 is a cross-sectional view of the piston ring of FIG. 2 along line 3.

In the embodiments of FIGS. 1 and 2, the thermal spray powder 20 is applied to the outer surface 22, 122 of the body 24, 124 to form the wear resistant coating. FIG. 3 shows a thickness t of the wear resistant coating applied to the body 124 of FIG. 2. The thickness depends on the thermal spray technique used, design of the body 124, and application of the wear resistant component 28. In one embodiment, the thickness of the wear resistant coating is 20 to 200 microns.

The method of forming the wear resistant component 28 can optionally include a post-spraying heat treatment. In one embodiment, the method includes annealing the thermal spray powder 20 after it is applied to the body 24, 124 or formed into the spray-formed part. The annealing or other heat treatment step could modify the microstructure of the thermal spray powder 20 by making it coarser. For example, the metal carbides could have diameter of at least one micron, rather than between 1 and 400 nanometers.

Another aspect of the invention provides a method of forming the wear resistant component 228, wherein the wear resistant component 228 is a spray-formed part consisting of the thermal spray powder 20, such as the piston ring of FIG. 4. The spray-formed part is manufactured by spraying the thermal spray powder 20 onto the substrate 238 to a thickness of up to 500 millimeters. The spray-forming process is a near-net-shape process and includes capturing a spray of powder on a moving substrate, as described in the ASM Handbook, Volume 7. This process provides several advantages, including densities greater than 98%, fine equiaxed grains, no macroscopic segregation, absence of prior particle boundaries, enhanced mechanical properties, material/alloying flexibility, and a high rate of deposition, such as greater than 2 kg/second.

In addition, the thermal spray powder 20 could be co-sprayed with other powders to form the wear resistant component 28, 128, 228, either the resistant coating or the spray-formed part. Examples of other powders that could be co-sprayed with the thermal spray powder 20 of the present invention include intermetallics, other hard phases, and metallic alloys. The wear resistant coatings 26 and spray-formed parts including the co-sprayed powders could provide a wide range of microstructures, different from the microstructures provided by the thermal spray powder 20 alone.

Obviously, many modifications and variations of the present invention are possible in light of the above teachings and may be practiced otherwise than as specifically described while within the scope of the claims.

What is claimed is:

1. A method of forming a powder metal material for use in a thermal spray technique, comprising the steps of:

providing a melted iron based alloy consisting of 3.8 wt. % carbon, 13.0 wt. % chromium, 2.5 wt. % tungsten, 6.0 wt. % vanadium, 1.5 wt. % molybdenum, 0.2 wt. % oxygen, 70.0 to 80.0 wt. % iron, and impurities in an amount not greater than 2.0 wt. %, based on the total weight of the melted iron based alloy; and atomizing the melted iron based alloy to provide atomized droplets of the iron based alloy.

2. A method of forming a powder metal material for use in a thermal spray technique, comprising the steps of:

providing a melted iron based alloy including 3.0 to 7.0 wt. % carbon, 10.0 to 25.0 wt. % chromium, 1.0 to 5.0 wt. % tungsten, 3.5 to 7.0 wt. % vanadium, 1.0 to 5.0 wt. % molybdenum, not greater than 0.5 wt. % oxygen, and at least 40.0 wt. % iron, based on the total weight of the melted iron based alloy;

atomizing the melted iron based alloy to provide atomized droplets of the iron based alloy; and grinding the atomized droplets.

3. The method of claim 1, wherein the atomizing step includes forming metal carbides in the iron based alloy in an amount of at least 15.0 vol. %, based on the total volume of the iron based alloy.

4. The method of claim 3, wherein the metal carbides are selected from the group consisting of: $M_8C_7$, $M_7C_3$, and $M_6C$, wherein M is at least one metal atom and C is carbon.

5. The method of claim 4, wherein $M_8C_7$ is $(V_{63}Fe_{37})_8C_7$, $M_7C_3$ is selected from the group consisting of: $(Cr_{34}Fe_{66})_7C_3$, $Cr_{3.5}Fe_{3.5}C_3$, and $Cr_4Fe_3C_3$; and $M_6C$ is selected from the group consisting of: $Mo_3Fe_3C$, $Mo_2Fe_4C$, $W_3Fe_3C$, and $W_2Fe_4C$.

6. A wear resistant component, comprising: a thermal-sprayed powder metal material, wherein said thermal-sprayed powder metal material consists of 3.8 wt. % carbon, 13.0 wt. % chromium, 2.5 wt. % tungsten, 6.0 wt. % vanadium, 1.5 wt. % molybdenum, 0.2 wt. % oxygen, 70.0 to 80.0 wt. % iron, and impurities in an amount not greater than 2.0 wt. %, based on the total weight of said thermal-sprayed powder metal material.

7. The wear resistant component of claim 6 further comprising a body with an outer surface, and wherein said thermal-sprayed powder metal material is disposed on said outer surface.

8. The wear resistant component of claim 7 wherein said body is a piston ring presenting an inner surface surrounding a center axis and an outer surface facing opposite said inner surface, and said thermal-sprayed powder metal material forms a coating on said outer surface.

9. The wear resistant component of claim 7 wherein said body is a piston presenting an outer surface, and said thermal-sprayed powder metal material forms a coating on said outer surface.

10. The wear resistant coating of claim 6 wherein said wear resistant component consists of said thermal-sprayed powder metal material.

11. The wear resistant coating of claim 10 wherein said wear resistant component is a piston ring.

12. The wear resistant component of claim 6 including a second powder metal material mixed with said thermal-sprayed powder metal material.

13. A method of forming a wear resistant component, comprising the steps of:

spraying a powder metal material which has been atomized and ground into atomized droplets, wherein the powder metal material comprises 3.0 to 7.0 wt. % carbon, 10.0 to 25.0 wt. % chromium, 1.0 to 5.0 wt. % tungsten, 3.5 to 7.0 wt. % vanadium, 1.0 to 5.0 wt. % molybdenum, not greater than 0.5 wt. % oxygen, and at least 40.0 wt. % iron, based on the total weight of the powder metal composition.

14. The method of claim 13 wherein the spraying step is a thermal spray technique selected from the group consisting of: powder flame spraying, plasma spraying, cold spraying, and high velocity oxygen fuel spraying (HVOF).

15. The method of claim 13 including heating the powder metal material before the spraying step, and wherein the powder metal material is heated during the spraying step.

16. The method of claim 13 wherein the thermal spray technique includes providing a combustion chamber containing a mixture of fuel and oxygen; igniting the mixture of fuel and oxygen; and feeding the powder metal material into the combustion chamber after the igniting step to accelerate the powder metal material.

17. The method of claim 16 wherein the igniting step includes creating a pressure in the combustion chamber, and accelerating the powder metal material up to a supersonic velocity.

18. The method of claim 13 including providing a body, and wherein the spraying step includes spraying the powder metal material onto the body.

19. The method of claim 13 wherein the spraying step forms the wear resistant component, and the wear resistant component is a piston ring presenting an inner surface surrounding a center axis and an outer surface facing opposite the inner surface.

* * * * *